US005676265A

United States Patent [19]

Miller

[11] Patent Number: 5,676,265

[45] Date of Patent: Oct. 14, 1997

[54] ELASTOMER SPRING/HYDRAULIC SHOCK ABSORBER CUSHIONING DEVICE

[75] Inventor: Lawrence E. Miller, Naperville, Ill.

[73] Assignee: Miner Enterprises, Inc., Geneva, Ill.

[21] Appl. No.: 640,597

[22] Filed: May 1, 1996

[51] Int. Cl.[6] ..... B61G 9/00

[52] U.S. Cl. ..... 213/49; 213/43; 188/314

[58] Field of Search ..... 213/40 R, 41, 213/43, 44, 45, 46 A, 49, 223, 220; 188/314; 267/219

[56] References Cited

U.S. PATENT DOCUMENTS

| | | | |
|---|---|---|---|
| 2,985,319 | 5/1961 | Simmons | 213/223 |
| 3,731,770 | 5/1973 | Bindon | 213/43 |
| 3,795,390 | 3/1974 | Kendall et al. | 213/43 |
| 3,802,576 | 4/1974 | Marsh et al. | 213/43 |
| 4,002,244 | 1/1977 | Matsumoto et al. | 213/43 |
| 5,104,101 | 4/1992 | Anderson et al. | 267/219 |

*Primary Examiner*—Mark T. Le
*Attorney, Agent, or Firm*—Dvorak & Orum

[57] ABSTRACT

A railcar cushioning device includes an elastomeric spring and a hydraulic shock absorber member. The fluid accumulator is located outside of and above the fluid chambers. The accumulator is in communication with the fluid chamber in a non-stroked position, causing entrapped air to be displaced by the fluid, into the accumulator. Free of air, the shock absorber immediately responds to impact forces. The elastomeric spring reduces peak impact forces and returns the piston of the shock absorber to its non-stroked position. The elastomeric spring also absorbs draft forces.

16 Claims, 11 Drawing Sheets

ELASTOMER SPRING/HYDRAULIC SHOCK ABSORBER CUSHIONING DEVICE

BACKGROUND OF THE INVENTION

1. Field of the Invention

The present invention relates to railway car coupler buff/draft gear assemblies. More particularly, the invention relates to an end-of-car cushioning device comprised of an internal elastomer spring in combination with a hydraulic shock absorber for absorbing and dissipating dynamic loading on the coupler, in both the buff and draft directions.

2. Description of the Prior Art

Over the past several decades, the railway industry has developed diesel locomotives with vastly improved torque capacities wherein the improvements have brought about great changes in the load-bearing capacity of trains, their physical parameters, and their operating characteristics. The physical and mechanical properties of the couplers which join the individual cars of the train has also changed to accommodate these improvements. The industry has moved to maintain close tolerances between all coupler components in order to lessen the impact forces on the railcar structures and lading, as well as providing energy-absorbing devices which protect the car understructure, lading and couplers.

In an exemplary coupling structure, which may be comprised of a drawbar or a standard E or F type coupler, the coupler member extends between the railcar side sills on each car. A butt end of the coupler usually has a convexly arcuate surface which abuts a complementary concave surface on a cast end sill member. The top, bottom, and vertically disposed side walls of the end sill member provide an enclosure for receiving the coupler, which must provisionally fit within an industry standard understructure and be readily removable in order to repair and replace coupler parts, and to disconnect coupled cars.

In any coupler system, it is desirable that the coupler member be held in a manner so as to eliminate or minimize longitudinal movement with respect to the car body. When cars are being moved, the longitudinal forces tending to separate the coupler from the end sill casting are encountered by a draft key or connecting pin, which is a metal bar extending laterally or vertically of the center sill, in a slot or pin bore in the shank of the coupler member. The coupler member is held tightly between the pin or key bearing block, however, the mating faces of the coupler and the end casting are preferably curved to permit a coupler to pivot, both vertically and laterally, and to permit the car to roll with respect to the coupler member. The coupler member also pivots at the draft key or pin connection on an arcuate pin or key-bearing block interposed between the parts.

Draft gear assemblies have been known and utilized in coupler systems to dissipate acceleration-type forces placed on a railcar, however, typical draft gear assemblies utilize large springs which add to the weight of the undercarriage structure, thereby displacing freight-carrying capacity of the railway car. As with most known draft gear assemblies, the intent of these assemblies is generally to only protect the underlying freight car structure from impact loading. Lading protection, however, requires a varying degree of energy dissipation and draft gear assemblies are not well suited in providing varying degrees of dissipation.

Buff gear assemblies are also known and utilized in railway car couplers in the form of compression spring assemblies. Buff gear assemblies are typically used between railway cars to buffer the impact loads created when adjacent cars are humped together and to compensate for the impact loads placed on the car couplers. A typical buff gear arrangement is illustrated in U.S. Pat. No. 4,556,678 to D. G. Anderson, and includes a mounting system for positioning the draft gear assembly. However, the utilization of a buff gear assembly alone has not been entirely feasible as these coupler devices tend to work best only one direction. Ideally, a cushioning device should be operable in response to both draft and buff forces, and be capable of operating within a designated, limited area underneath the center sill structure.

Sliding sill arrangements were later developed to meet these needs and to accommodate lading protection. These devices are generally complicated hydraulic shock absorbing assemblies with attendant higher capability to dissipate energy loss. These end-of-car cushioning devices have evolved such that these units can be installed outboard of the car bolsters, but typically do not fit within the standard draft gear pockets. The hydraulic cushioning devices have greater energy absorbing ability than conventional draft gears, but Usually require greater understructure travel distances relative to springs. Early shock absorber devices such as the ones disclosed in U.S. Pat. No. 3,215,283 to W. R. Shaver have been utilized to successfully dissipate high impact energy loads in relatively short travel distances. However, the early devices like that of Shaver, required a rather heavy, structural spring for assisting the shock absorber piston in returning to its fully run-in position in a relatively short amount of time. This spring return arrangement unnecessarily adds to the understructure weight of a railcar. The more recent hydraulic dampening units have eliminated the use of the spring and have substituted a high pressure inert gas to perform that same function. With the gas return systems, a rapidly dispensed high pressure flow of gas is directed into the hydraulic fluid chamber in order to facilitate and speed the return rate of the piston to its run-in position. The hydraulic/gas systems can be used for absorbing forces in both directions, however, one overriding disadvantage of these high pressure systems is that they have an inherent tendency to leak around the seals after they have seen regular use and wear. For that reason, two-way hydraulics have been proposed, as in U.S. Pat. No. 4,591,031, to Kist, but commercial application of that design in the railway industry has never materialized. More commonly used two-way hydraulic end-of-car devices are exemplified in U.S. Pat. No. 5,415,303 to Hodges, et. al. Such devices have been more accepted, but one disadvantage to these types of devices lies in the multiplicity of pressure relief valves used to operate at various pressure levels. As the impact force increases, each relief valve is set to begin flowing fluid therethrough at a progressively higher pressure. This means that the valving is subject to valve adjustments and set-up that has a tendency to drift or even fail over time.

Another disadvantage with strictly hydraulic-type device concerns preload of the unit. Preload is a vitally important factor needed with hydraulic end-of-car cushioning devices because in a moving train, slow-rate closures caused by conditions such as traveling over track sections with rapid grade changes, can slow the rate of closure and close out conventional hydraulic units, thereby depleting their available travel. If subsequent rapid deceleration occurs, as does with hard braking, these units will have very limited travel available for dissipating energy. Any relative velocity differences between coupled railcars can then result in forces that can subject the railcar lading to damaging accelerations. Preload helps in overcoming those conditions. Preload can be accomplished in a strict hydraulic-type device by utilizing nitrogen gas charge, however, this does not make possible a slow-closure spring rate that reacts with substantially increasing resistive forces as a function of travel. During in-train conditions, such a nitrogen-charged device will allow only limited control of the end sill casting travel position and result in allowing more unwanted free-motion, or run-in, between cars. The greater the number of such gas-charged devices in a particular train, the greater this free-motion effect will translate into an accordion-like effect of uncontrolled, slow-closure, car-to-car motions. This will make train handling increasingly difficult. In a comparison of the present invention with a preloaded conventional, gas-charged unit, FIG. 16 illustrates an over-the-road computer simulation of this effect on the 44th car in a sixty-car train.

However, one disadvantage of preloading is that the efficiency of dissipating yard impact cushioning is reduced. The most efficient dissipation of peak impact forces by a shock absorbing device is achieved by decelerating the moving mass at a constant rate throughout the available stroke, or to at least try to approach a constant rate.

In the quest for developing a two-directional device, a recent apparatus was designed to absorb the loads on the coupler system in both directions of travel with an elastomeric spring, and is illustrated in U.S. Pat. No. 5,312,000 to Kaufhold et al. In that disclosure, a series of elastomeric toroidal cushion pads are provided to substitute for the commonly known steel coil spring draft gear. This device was said to absorb sudden acceleration forces in the draft direction, and absorb shock-loading forces created in the buff direction when cars are being humped. However, one known shortfall of purely elastomeric devices is that they inherently have a greater load-absorbing capacity in direct relationship to the amount of compression of the spring. This means that little or very low energy absorption will take place until the pads have become almost fully compressed.

Other recent devices which have two-direction functionality have been developed so that the individual advantages of the hydraulic shock-absorbing device and the elastomeric spring device are synergistically combined so that the best operating features of each individual component are realized. For example, U.S. Pat. No. 5,104,101 to D. G. Anderson presents a buffer cartridge which includes an elastomeric element that is similar to the TECSPAK® element employed in the present invention. With this buffer cartridge, it was realized that the hydraulic component is very velocity sensitive, while the elastomeric component is not, so a combined type of device was advantageously discovered to protect the railcar understructure from velocity-related impacts, such that the lading would be protected regardless of velocity-related events. In the '101 buffer cartridge, a stretchable accumulator seal surrounds the piston rod with the hydraulic fluid and functions to reduce internal cylinder pressure by expansion of the accumulator. One disadvantage of this particular apparatus is that the stretchable accumulator is subject to wear and leakage. However, this cushioning system advantageously eliminates the use of heavy return springs by substituting the elastomeric pads as the means for returning the piston to its run-in position; the pads also function to absorb impact and acceleration loads.

Another disadvantage when these two components are combined, is that the hydraulic element of the device inherently absorbs and dissipates energy at the beginning of its piston stroke, which corresponds to the start of impact. Any air or gas which is present in the primary fluid chamber of the hydraulic cylinder will create a time lag in hydraulic energy dissipation. When this occurs, the hydraulic and elastomeric elements will be dissipating kinetic energy concurrently, and their individual energy dissipating capacities will combine at the same time to allow greater peak forces than desired.

SUMMARY OF THE INVENTION

It is therefore a prime objective of the present invention to provide an energy-absorbing device which incorporates the features of resilient material compressibility with hydraulic fluid damping applications.

It is another object of the present invention to provide an hydraulic energy absorbing element in parallel operation with an elastomeric spring element, the combination device fitting within the dimensional tolerances of a standard railcar pocket without requiring structural modifications, wherein the hydraulic element is required to have rapid energy absorption and quick response in order to reduce yard impact forces and dissipation of kinetic energy.

It is another object of the invention to provide an energy-absorbing device that can be preloaded without sacrificing yard impact cushioning.

It is a final object of the present invention to provide an hydraulic element which has an almost-mediate energy absorption and response in order to reduce yard impact forces and dissipation of kinetic energy, even if preloaded, said almost-immediate response resulting from an external accumulator for reducing fluid pressure within the cylinder. The location of the accumulator eliminates the need for seals which are subject to wear and facilitates the rapid removal of air or gas from the main hydraulic fluid chamber, thereby eliminating the time lag normally created by air or gas.

The present invention overcomes the above problems by providing a means for rapid removal of air or gas from the main fluid chamber of the hydraulic absorbing device when initially activated. Devices exist that have a means for venting air from the main hydraulic cylinder, however this invention is capable of operating in conjunction with an energy absorbing elastomeric spring and within the same dimensional tolerances of a hydraulic shock absorbing device. Existing double cylinder hydraulic damping devices typically require that the outer cylinder be substantially larger with respect to the inner cylinder. The present invention reduces dimensional tolerances of former hydraulic cushioning devices as a result of the elastomeric spring elements working in conjunction with the hydraulics, thereby allowing a downsizing of the hydraulic fluid area needed to perform damping functions.

The present invention also overcomes typical problems of hydraulic units by providing specially located and integral accumulators which stabilize the movement of the hydraulic fluid by containing it in small chambers, rather than in the usual single, large volume chamber. In this way, trapped air can quickly rise through the fluid and escape, and this rapid dissipation of entrapped air eliminates the hydraulic lag time that is normally created from the air moving through a large mass of hydraulic fluid oscillating back and forth in the typically large-volumed reservoirs.

BRIEF DESCRIPTION OF THE DRAWINGS

Other objects and advantages of the invention will become apparent upon reading the following detailed description and upon reference to the drawings in which.

DESCRIPTION OF THE PREFERRED EMBODIMENT

Figure 1:
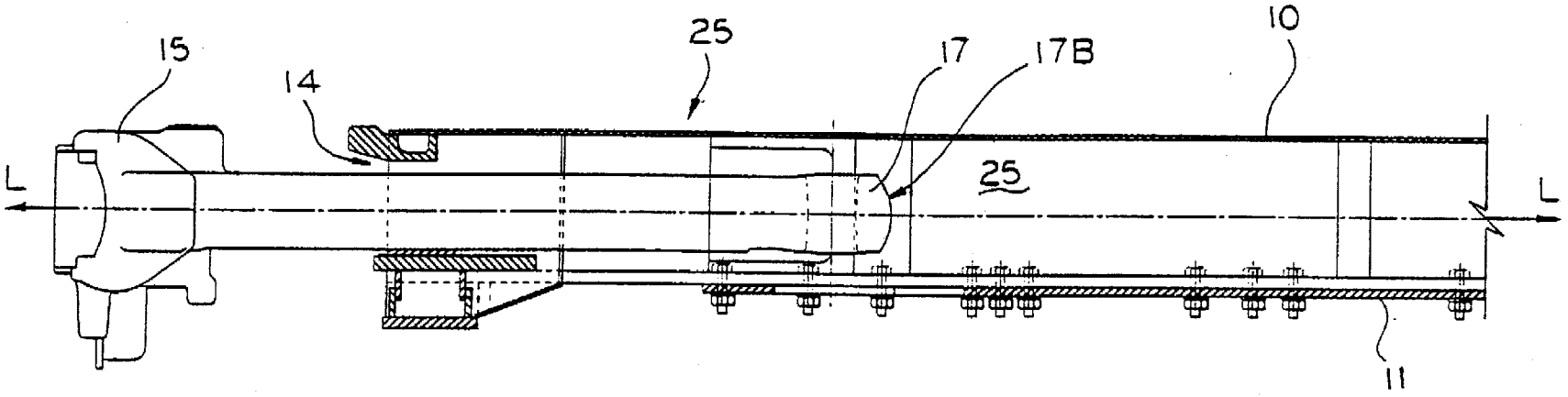
FIG. 1 is a side view in partial section of the cushioning device of the present invention within a railcar center sill.
Figure 2:
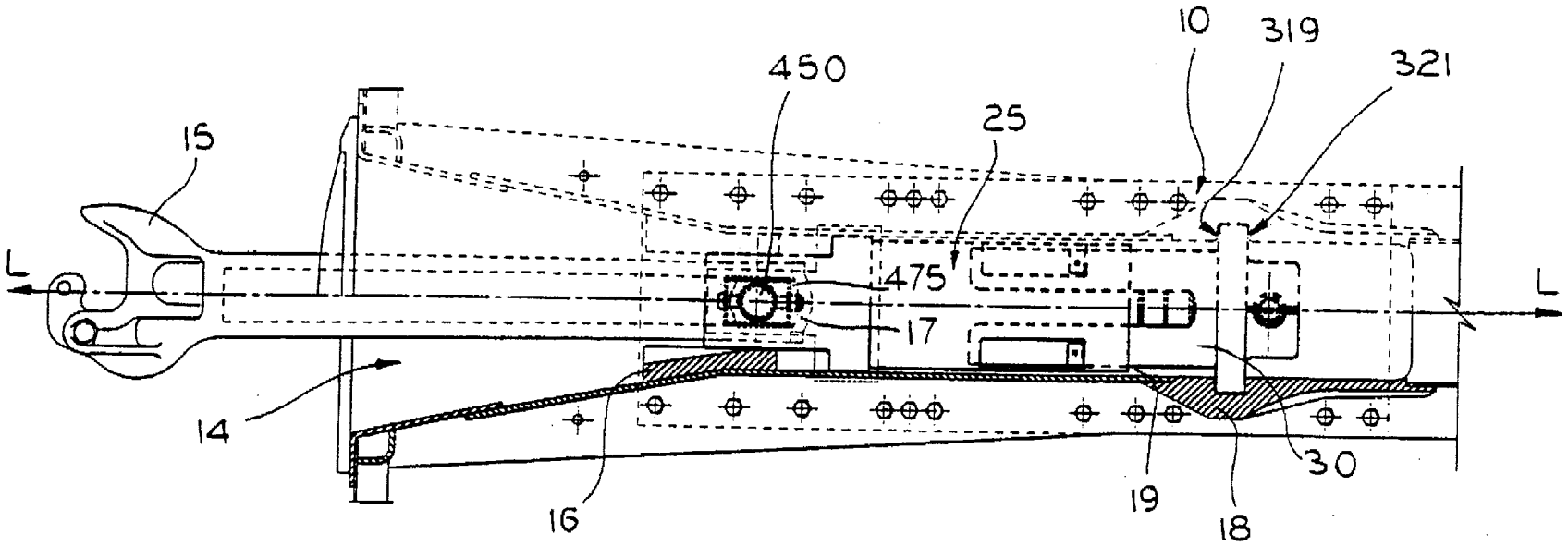
FIG. 2 is a top view in partial section of the device of FIG. 1.

The railway car cushioning device of the present invention is illustrated at 25 in FIGS. 1 and 2, and is mounted within an inverted U-shaped railcar center sill 10 having a longitudinal axis L and is supported and retained by a plate 11. The open end 14 of the center sill includes a set of opposed front stops 16 and a set of opposed rear stops 18 that are longitudinally displaced inward from open front end 14 and front stops 16. The front and back stops are mounted to the center sill side walls and the distance between the front and back stops defines a center sill pocket 19 which receives the cushioning device 25 of the present invention. A coupler member 15 is connectively pinned to cushioning device 25 generally at a butt end 17, internal of open end 14. The coupler member 15 extends outside the center sill 10 and is connected to a similar unit on an adjacent railway car. The cushioning device 25 is shown removed from the center sill in FIG. 3, and is seen to be comprised of a headstock casting member 300, an end sill casting 400, and a central body portion 28 joining each of the casting members 300, 400. The central body portion 28 is comprised of an inner telescoping housing 30 and an outer telescoping housing 40. The inner housing is preferably cast as part of headstock member 300, while outer housing 40 is welded to end sill casting 400. Inner housing 30 is concentrically received within the cavity 45 of the outer housing 40. Each housing is capable of inward and outward movements relative to each other, along a path defined by longitudinal axis L.

However, it should be understood that the inner housing 30 remains stationary at all times, while only outer housing 40 moves. During buff loading on the railcar coupler, butt end 17 is pushed into the center sill and towards the rear stops 18, causing the outer housing to disengage from contact with the front stops 16. During draft loading, the coupler is pulled in a direction out of the center sill, such that the cushioning device contacts the front stops 16. The longitudinal distance each housing member can travel relative to the other is controlled so that over-compression or over-extension will not occur and cause damage to the device.

Figure 3:
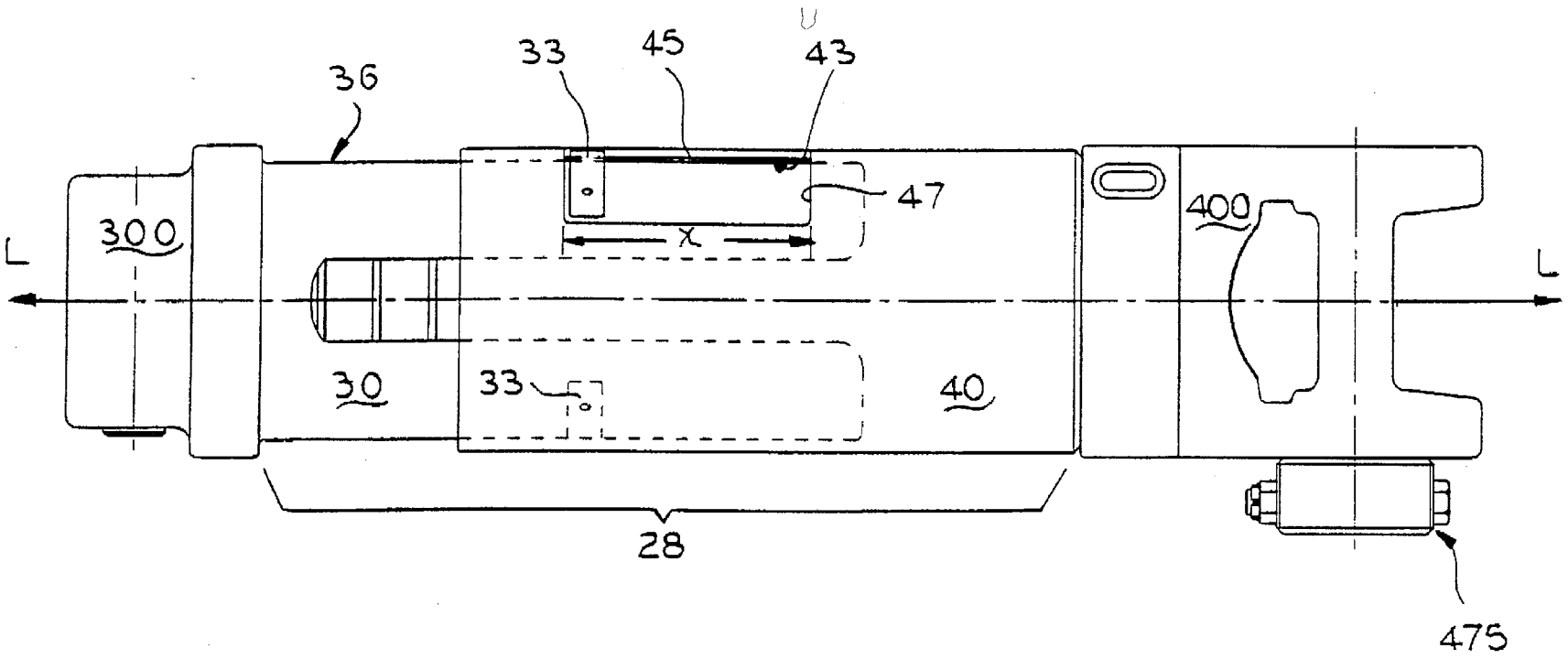
FIG. 3 is a side view of the device of the present invention.

As FIG. 3 also shows, keyways 33 are mounted on the outer surface 36 of the inner housing 30, and are operative within open slot 47 that is provided in the outer housing 40. The outside surface 36 of inner cylinder 30 is in sliding contact with the inside surface 43 of outer cylinder 40. The total longitudinal displacement provided to device 25 is designated as "X", shown as the length of the slot 47 in the illustration, minus the thickness or longitudinal extent of the keyway 33. As mentioned earlier, the displacement "X" is such that device 25 is fully operable between front and rear stops 16, 18.

Figure 4:
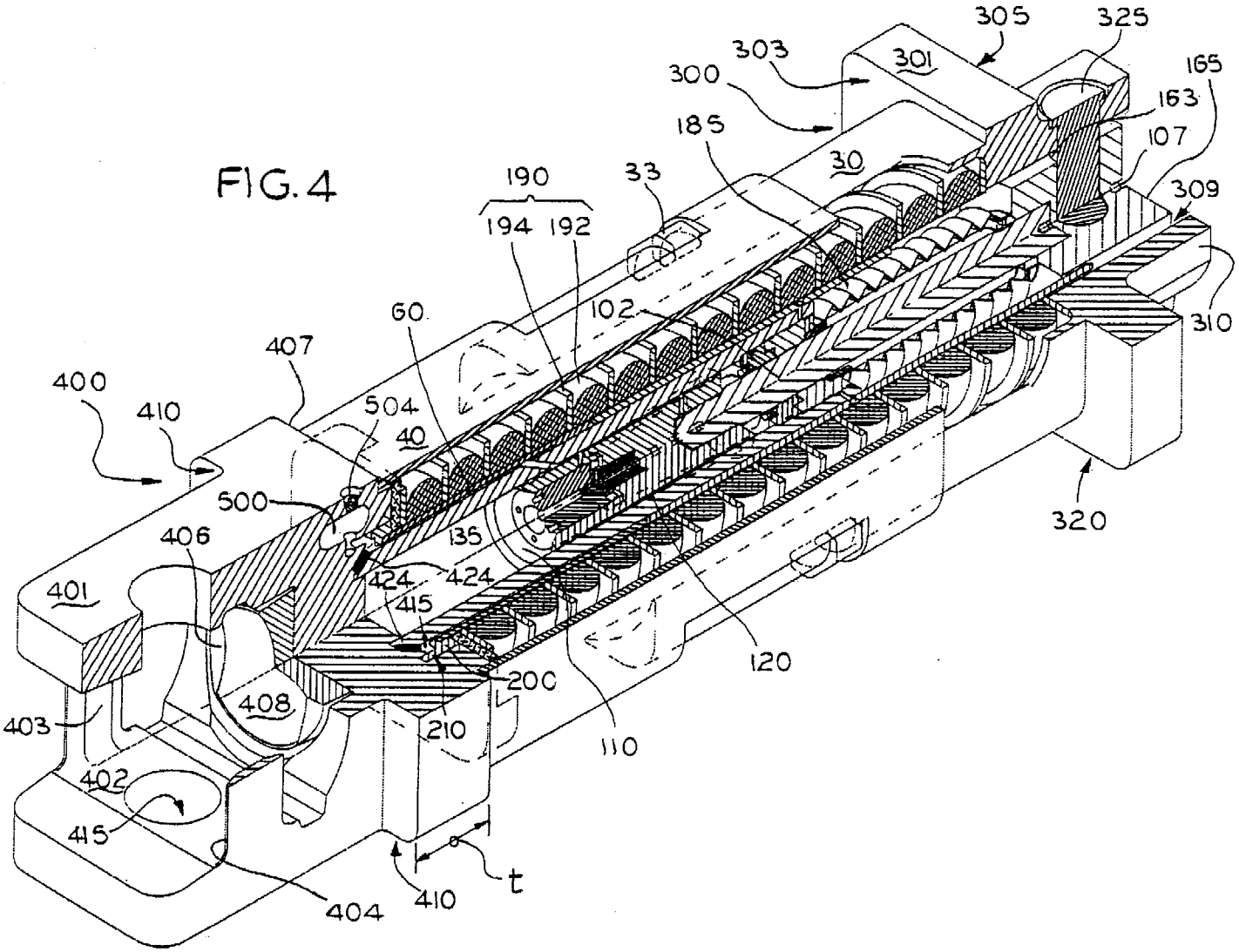
FIG. 4 is a perspective view in partial section of the cushioning device of the present invention.
Figure 5:
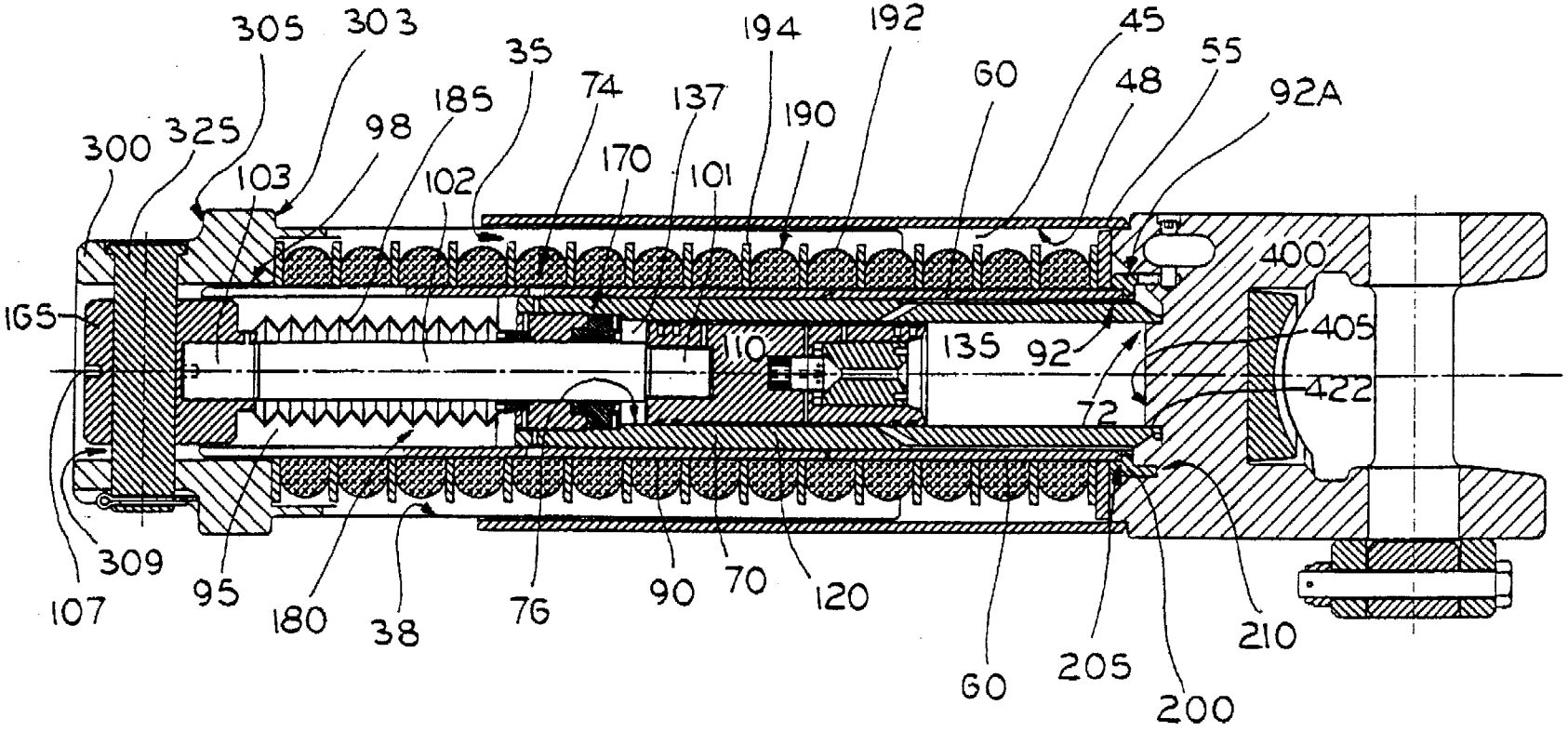
FIG. 5 is a side cross sectional view of the cushioning device of the present invention.

From viewing FIGS. 4 and 5, it is seen that each housing 30, 40, has a respective, open interior 35, 45, and that an operating cylinder 180 is contained therein; the operating cylinder has a longitudinal length equivalent to the longest length of the body portion 28 when it is in its extended state, as during draft loading. Operating cylinder 180 is formed from concentric cylinders 70 and 90, and has a separation distance therebetween which defines an internal annular reservoir 60. Outer cylinder 90 extends between end sill casting 400 and headstock casting 300, while inner cylinder 70 only partially extends therebetween. The operating cylinder 180 receives a fluid displacement means 100 having a piston head 110 and a piston rod 102 such that an internal reservoir 120 is formed between inner cylinder 70 and piston 110. The front end of operating cylinder 180 includes the front or first ends 72, 92 of each of the cylinders which are fixedly mounted to the back wall 405 of end sill casting 400. The outer cylinder end surface 92A is received within a seat 205 of cylinder adapter 200. Adapter 200 on the other hand, has an annular flange 210 that is secured within an outer annular groove 420 formed in back wall 405. The front surface 72A is secured to inner annular groove 422, and is then welded in place by weldment material 424. An annular chamber 415 is formed between cylinder adapter 200 and first or fixed end 72 of inner cylinder 70, and is in fluid communication with internal reservoir 60. The back end of operating cylinder 180 includes second end 74 of inner cylinder 70 that is provided with a sealing assembly 170 to retain the hydraulic fluid within a secondary fluid chamber designated at 137. The sealing assembly frictionally contacts the inside surface 76 of inner cylinder 70 and is secured thereto by threads and set screws on each complementary surface (not shown) to effectively enclose and seal cylinder end 74. Assembly 170 is comprised of a seal wiper retainer 172, cylinder cap 174, a seal gland 176 and a main seal 178. The details of the sealing system will not be provided in greater detail, other than adding that a sealing bellows member 185 is attached to the same end 74, and which, extends to and connects with outer cylinder end cap 165. Bellows member 185 functions as a dirt seal between piston rod 102 and interior 95 of outer cylinder 90 so that any fluid which might leak past the sealing assembly 170 during peak loading periods will not become contaminated and possibly make its way back into the fluid system. The sealing system is located such that the volume of secondary fluid chamber 137 is fixed at a ratio with respect to the volume of the primary fluid chamber 135.

The interior of cylinder 70 effectively forms the primary and secondary fluid chambers 135, 137 once the fluid displacement means 100 is inserted therein. The means 100 is comprised of an elongate cylindrical piston rod 102 having a first threaded end 101 inserted within the threaded blind bore 122 formed in the bottom end 114 of piston head 110 and is held therein by set screws 100 (See FIG. 9). Set screw 100 prevents the piston head 110 from rotating off of its top-dead-center position. It is critical to prevent piston head movement or else the fluid pathways within the operating cylinder would be non-existent. Second piston end 103 is inserted within an end cap 165 that is connected to the piston rod 102 by set screw 107, while end cap 165, in turn, is connected to the headstock casting 300 by a large pin 325. Since piston rod 102 is fixed at its second end 103, it can be appreciated that fluid displacement means 100 will not move during buff/draft loading on cushioning device 25. Rather, since inner and outer cylinders 70, 90 are fixed to end sill casting 400, they will longitudinally displace relative to piston rod 102 and piston head 110 when end sill casting 400 and outer telescoping housing are displaced in the longitudinal direction.

Cushioning device 25 is seen to also include an elastomeric spring assembly 190 received within the open interiors 35, 45 of each telescoping housing member 30, 40, and extending the entire longitudinal extent of central body portion 28. As seen, spring assembly 190 is comprised of a stacked plurality of toroidally or similarly configured elastomeric spring segments or pads 192 that are arranged with spacer plates 194 therebetween. In one embodiment the pads are manufactured and sold by Miner Enterprises, Inc. of Geneva, Ill. under the trademark TECSPAK®, more fully described under U.S. Pat. No. 4,198,037. Each pad and plate has a respective central aperture (not shown) such that spring assembly 190 is slid over the outside surface 98 of outer cylinder 90 of operating cylinder 180 and frictionally rests thereon. Spacer plates 194 are configured according to the physical interior shape of the outer and inner housings (albeit round, square, etc.), and as the figure shows, a very small gap exists between each plate edge surface 194 and inner surface 38 on inner housing 30 to allow longitudinal displacement of the plates when the pads are compressed. That same gap exists between the inside surface 48 of the outer housing and the outer surface of overtravel stop 55. The structure of spring assembly 190 is a known embodiment of a draft gear assembly for absorbing buff forces in a coupler assembly. However, this particular arrangement also functions as a simplistic and relatively lightweight hydraulic piston return means, as will be better understood through the later-following operational description of the cushioning device.

In the usual operation, the fluid displacement means 100 remains in a balanced position, where in the absence of external buff/draft forces, the piston head is held by means of the elastomeric spring assembly 190 such that the volume of the primary and secondary chambers 135, 137 are equal. Advantageously, the elastomeric spring assembly 190 can also maintain a preload on the cushioning device even at zero velocity, thereby eliminating the need for high pressure gas charging systems or heavy mechanical springs to accomplish the same piston-return and pre-loading effect. Preload is accomplished by locking elastomeric spring assembly 190 in a pre-shortened length under an induced static preload. The pre-shortened length provides sufficient clearance for easy installation of device 25 within pocket 19, and once it is installed, a first coupler impact (buff load direction) beyond the preload force, will cause a pre-shortening lock (not shown) to be automatically retracted into an unlocked position. Once this event occurs, the cushioning device 25 will be free to operate within its full range of longitudinal travel, while still maintaining the preload on the coupler member. The key lock 33, will remain in a retracted position until it has been manually re-engaged.

Figure 9:
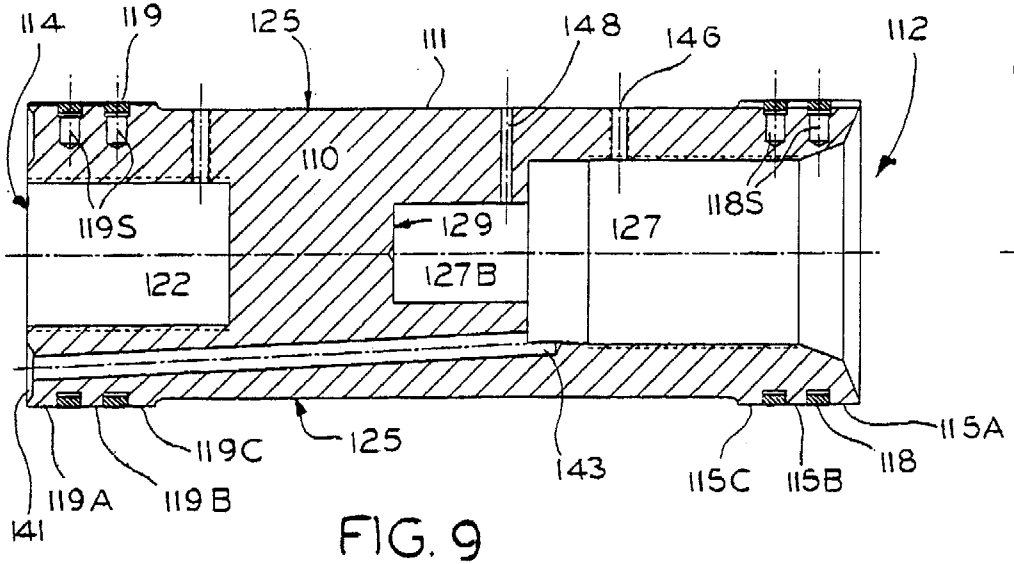
FIG. 9 is a side cross sectional view of the piston head of the hydraulic fluid displacement means.

FIG. 9 shows in greater detail that piston head 110 has an annular step 125 cut into its outside surface 111. When the piston head is inserted within operating cylinder 180, the step forms a fluid retention cavity between the piston head and the inner cylinder 30 of the operating cylinder 180. This cavity is in communication with the top and bottom cavity vent holes 121,123, interconnecting the internal reservoir 60 with the fluid retention cavity 120 (See FIG. 14). Thus, it can be appreciated that a hydraulic fluid passage exists from the primary and secondary fluid chambers 135, 137 to the accumulator 500 when the operating cylinder is in a certain stroked position. Furthermore, any air entrained within the fluid system can be easily displaced out of the primary and secondary chambers from the weight of the fluid forcing the air upwards, and into the accumulator, where it can be bled before the cushioning device is placed in service.

Figure 10:
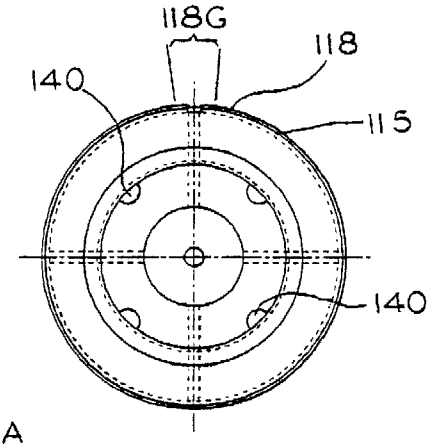
FIG. 10 is an end view of the piston head shown in FIG. 9.
Figure 11:
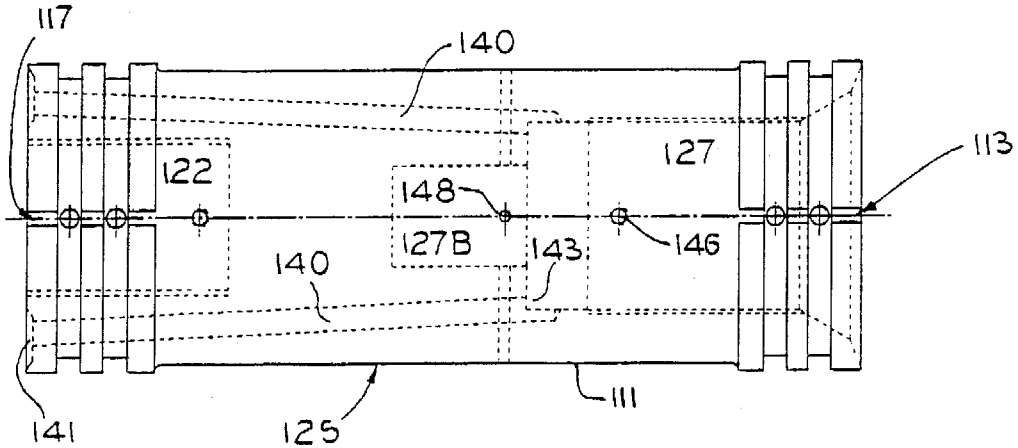
FIG. 11 is a top view of the piston head shown in FIG. 9.

FIG. 9 further illustrates that piston head 110 has top and bottom ends 112, 114 provided with conventional piston rings 118, 119 while the body area in between the rings is substantially relieved with an inwardly stepped portion 125 that forms the fluid retention cavity 120 between the piston head 110 and the inside surface 76 of inner cylinder 70 when the piston is inserted therein. The piston rings 118, 119 are respectively inserted between piston lands 115A, 115B, 115C, and 119A, 119B, 119C, and as seen in FIG. 11, each of the top and bottom sets of lands are provided with a respective longitudinal groove 113, 117 through each set. Although not shown in the figures, those familiar with pistons and piston rings, know that piston rings are not a continuously solid ring. Rather, they are split so they can be slipped over the piston outside surface. Thus, a ring gap exists where the piston ring is split and as with all piston rings, the gap can be varied, usually in accordance with the type of ring material used and the temperature of the operating environment. The piston rings 118, 119 of the present invention have their respective ring gaps 118G, 119G facing upward into the respective grooves 113,117 (See FIG. 10). All grooves 113, 117 and ring gaps 118G, 119G, are in longitudinal alignment with each other in order to create a fluid pathway, which will conduct hydraulic fluid between the primary and secondary reservoirs while still maintaining a fluid seal along the outer surface of piston, as will become clearer when the operational aspects of the present invention are explained. It should be clear from FIG. 10 though, that the gap in ring 118 is wide enough so as not to block any portion of the longitudinal groove 113 passing through each of the front piston ring bands. The set screws 118S and 119S are provided to prevent each piston ring from rotating out of alignment with its respective groove 113, 117 and thereby blocking the fluid path. Turning attention again to FIG. 9, an internal set of longitudinal passageways 140 angularly extend between bottom and top ends 112, 114 and terminate at a front end 143 and back end 141. The top view of piston 110 in FIG. 11, along with the end view of FIG. 10 should make it clear that there are four such passageways extending within the piston body, each one being spaced ninety degrees apart. Each passageway 140 intersects with an annular fluid pocket 160 at end 143, said pocket created when the valve body 154 (FIG. 14) is secured into internal piston chamber 127. Set screw 146 is provided for preventing body 154 from unthreading itself out of chamber 127.

Figure 14:
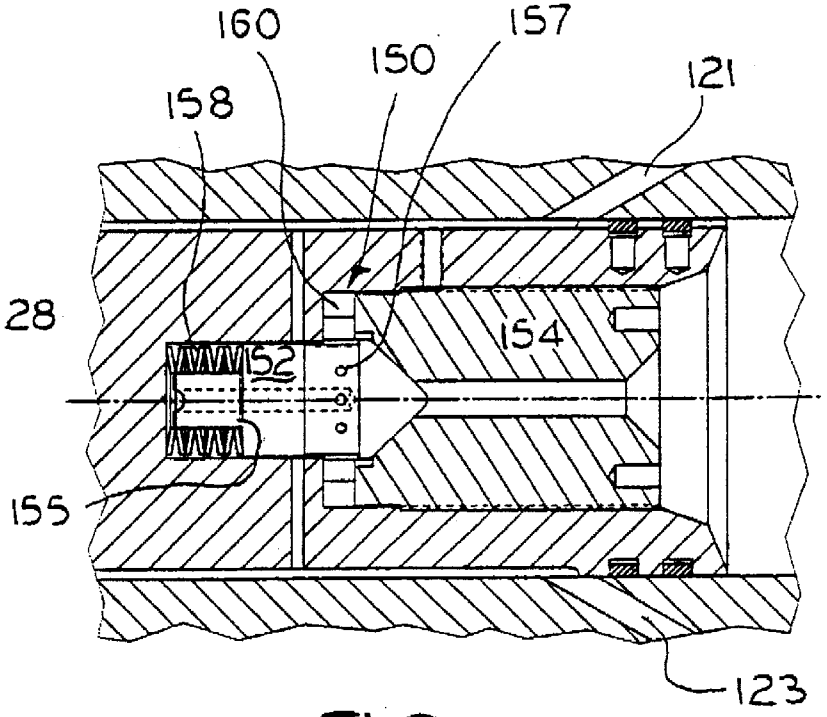
FIG. 14 is a detailed sectional view of the poppet valve assembly within the piston head.
Figure 12:
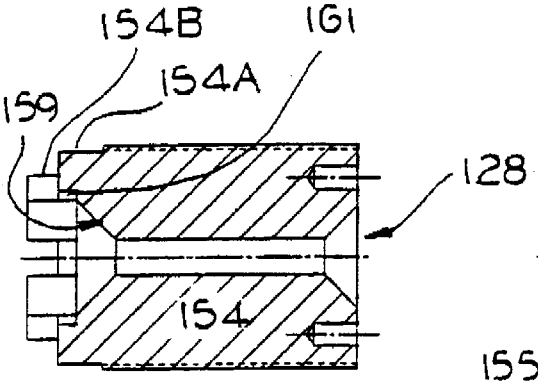
FIG. 12 is a side view in cross section of the internal poppet valve body.
Figure 13:
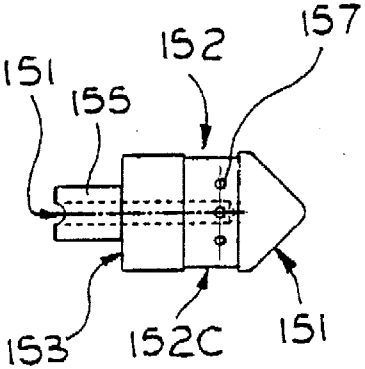
FIG. 13 is a side view of the poppet valve gate.

As FIGS. 12–14 show, valve body 154 and valve gate 152 cooperate within chamber 127 to form a poppet valve assembly 150 (Also see FIGS. 4, 5) that operationally performs three functions: 1) operates as a check valve; 2) operates as a pressure relief valve; and 3) operates as an on/off valve. These aspects of poppet valve assembly 150 will be explained later. However, it is important to note that poppet valve assembly 150 is provided with stub 155 resting on bottom surface 129 of the lower portion 127B of internal chamber 127. The stub is surrounded by Bellville springs 158 that function to bias poppet valve gate 152 and hence, surface 151 into fluid-tight contact against gate seating surface 159. When fluid pressure in the primary fluid chamber 135 reaches a preset value, which is equivalent to the spring force of the stacked springs, the fluid pressure will compress the springs and unseat the valve to allow fluid movement out of the primary chamber. The actual fluid path during operation of cushioning device 25 will be explained below.

Figure 6:
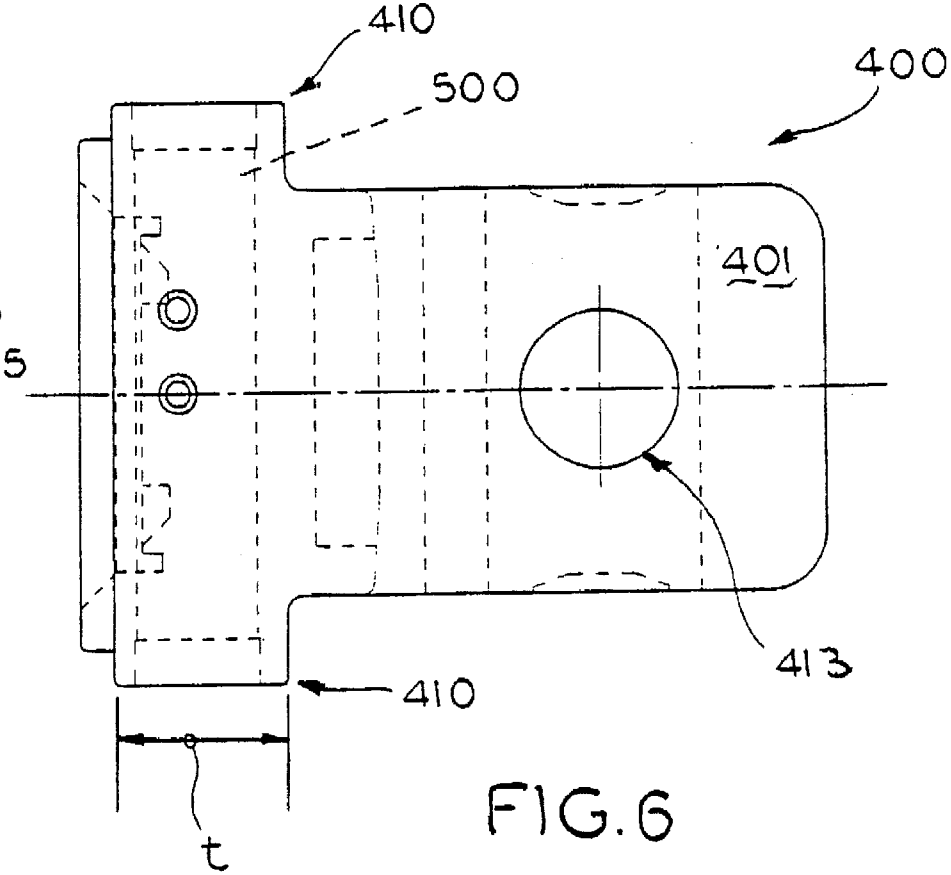
FIG. 6 is a top view of the end sill casting portion of the cushioning device of the present invention.

Turning attention now to FIGS. 4 and 6, it is seen that the end sill casting 400 has a front side formed by the interconnection of the top wall, bottom wall, side walls and back wall (401, 402, 403, 404, 405) thereby forming an enclosure for receiving the butt end of the coupler member therein, as was shown in FIG. 2. The vertically aligned holes 413 and 415 accept a connecting pin 450 for physically connecting the coupler member 15 to the cushioning device 25 of the invention. Pin 450 is prevented from displacement by anchoring pin and block means, 475, seen in FIGS. 2 and 3. As seen, the front surface 406 on the back wall is provided with a concavely contoured portion 408 to receive a complementarily convexly contoured surface 17B on the butt end 17 of the coupler member (See FIG. 1). Back wall 405 also has lateral extensions that provide upright tabs 410 for abutting contact with the center sill front stops 16.

Figure 7:
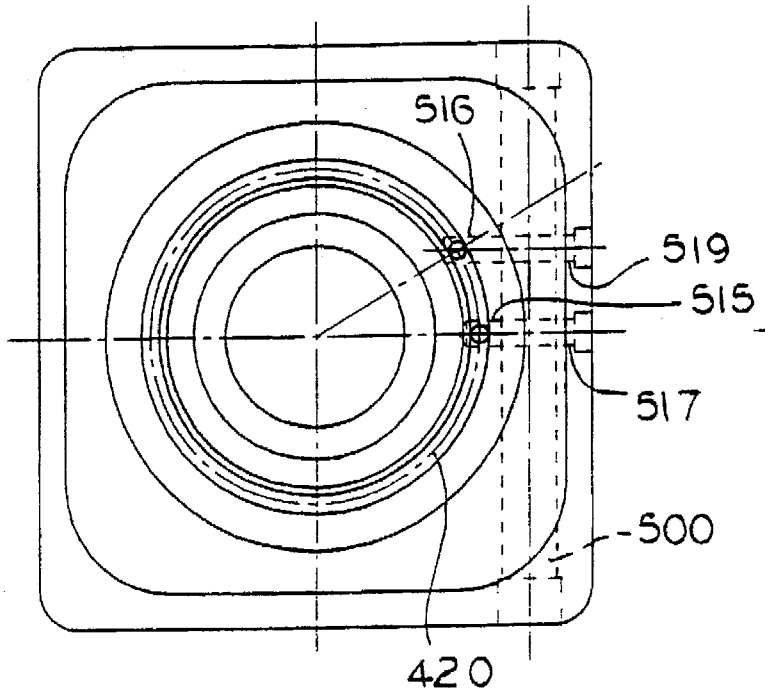
FIG. 7 is a front view of the end sill casting portion of FIG. 6.

The rear surface 407 of the back wall is generally planar, and as seen, the longitudinal extent between the front and rear surfaces, designated herein as "t", is intentionally substantial so that an internal accumulator 500 can be provided therein. The accumulator substantially spans the thickness "t" of the back wall 405, as well as the width of the back wall; the accumulator is shown in FIG. 6 as a dashed-line rectangle. As FIG. 7 shows, accumulator 500 is indirectly in communication with outer annular groove 420, which as mentioned, forms annular chamber 415 when the inner cylinder 70 and the cylinder adapter 200 are inserted within end sill casting 400. Fluid communication between accumulator 500 and annular chamber 415 is best understood by viewing FIG. 7 where it is seen that the passages 514, 516 vertically extend from accumulator 500 downwardly to a respective location where the arcuate annular groove 420 is intercepted. The upper filler ports 517, 519 communicate the accumulator 500 to the atmosphere so that hydraulic fluid can be added to the hydraulic damper member. Hydraulic fluid is added through filler port 519 so that it can gravity drain downwardly into the primary and secondary fluid chambers 135, 137. One very important aspect of the present invention is that the accumulator 500 is provided external of the operating cylinder 180, and lies above both the primary and secondary fluid chambers 135, 137. In this way, a unique air-bleeding arrangement can be provided. By this, it is meant that as fluid is added through filler port 519, any gas (air) that is present in the primary and secondary chambers will be displaced by the heavier hydraulic fluid entering the device when it is being filled. Thus, it can be appreciated that an accumulator positioned at an upper-most position in the hydraulic system will effectuate air removal when hydraulic fluid added at the top, displaces the lighter air molecules out of the primary and secondary chambers, the internal reservoir 60, the fluid retention cavity 120, and the cavity vent holes 121, 123. The hydraulic fluid eventually reaches an equilibrium point at the highest point in the fluid system, namely somewhere within the accumulator 500. With the air evacuated from the primary and secondary chambers and from the remainder of the fluid communication system, the cushioning device of the present invention will respond to impacts with immediate energy absorption. This immediate response is unlike prior art hydraulic devices because they do not have the capacity to eliminate the air entrapped within the primary and secondary fluid chambers before impact loads are encountered. Rather, most prior art devices attempt to vent the air in these chambers only when the fluid system is acted upon.

FIGS. 4 and 5 best show that the headstock member 300 is substantially comprised of a base plate 301, a rearward facing neck 310 projecting outwardly from a back surface 305 said base plate, and the forward-facing inner housing 30, which is integrally cast as part of the headstock member. A central throat 309 extends through neck 310 and into the interior cavity 35 of inner housing 30. The outwardly projecting neck 310 generally has a rectangular configuration, and is comprised of a top, bottom, and pair of side walls extending from the base plate. The top and bottom walls of the neck respectively have vertically aligned openings for receiving the large pin 325, that is likewise received in a vertically aligned aperture 163 in the piston rod end cap 165. Pin 325 also includes a horizontally directed aperture at its bottom end so that a cotter pin or similar means will tie the rod end cap to the headstock casting through the pin 325.

The front surface 303 of base plate 301 is integrally formed with the second or back end 32 of the inner telescoping housing 30. Housing 30 is centered about central throat 309 and on base plate 301. Inner housing 30 extends towards the center sill front stops so that its front and free end 34 is received within cavity 45 of outer telescoping housing 40. Base plate 301 also includes an opposed pair of laterally projecting, upstanding lugs 320, which are functionally equivalent to the lateral upstanding tabs on the end sill member. FIG. 2 best shows that each lug has a front and rear surface which is inserted within a complementary groove in the rear stops 18 so that each front and rear surface tightly contacts and seats within the rear stop. The lugs 320 function to transmit buff/draft loading forces into the center sill side walls and distribute loading forces throughout the center sill structure when the coupler 15 is acted upon.

The operation of the present cushioning device will now be described. First turning attention to FIG. 1, it is seen that device 25 is effectively situated between front stops 16 and rear stops 18. As previously mentioned, the inner telescopic housing 30 is held stationary with respect to outer telescoping housing 40 due to its relationship with rear stops 18. Since piston rod 102 is pinned to inner housing 30, it too is stationary with respect to outer housing 40. Therefore, it should be realized that only the outer housing 40 and end sill casting member 400 will physically displace longitudinally along axis L when buff and draft loads are encountered. For the sake of this discussion, whenever the end sill casting member 400 is described as moving in the draft or buff directions, it is to be implied that the movement is caused by a force acting upon coupler member 15 which is connectively pinned to member 400, although the particular illustration being described might not show the coupler member 15 being connected thereto. Also, it should be made clear to those not familiar in the art, that buff loads are those pushing the coupler member 15 deeper into center sill 10, while draft loads are those pulling on the coupler member 15.

Figure 15A:
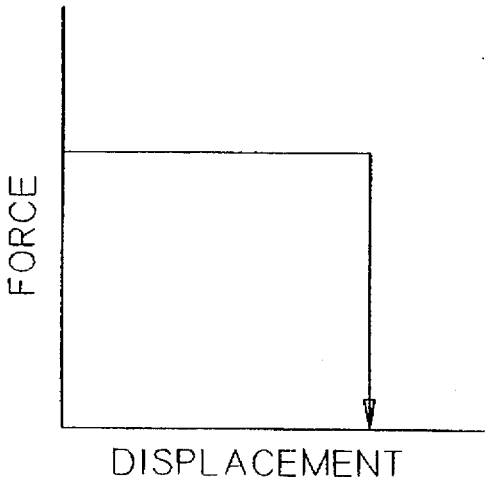
FIG. 15A illustrates an ideal force versus travel curve for an end cushion device.
Figure 15B:
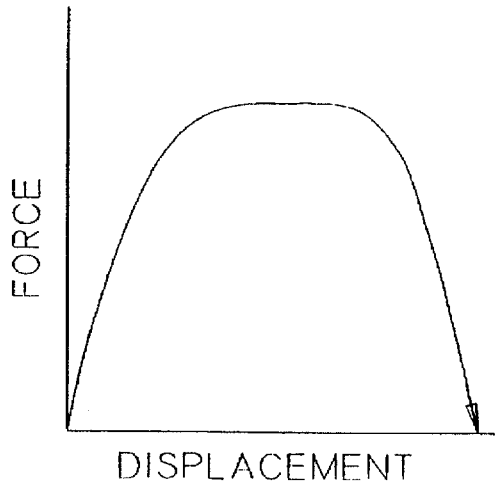
FIG. 15B illustrates a force versus travel curve for a purely hydraulic end cushion device.
Figure 15C:
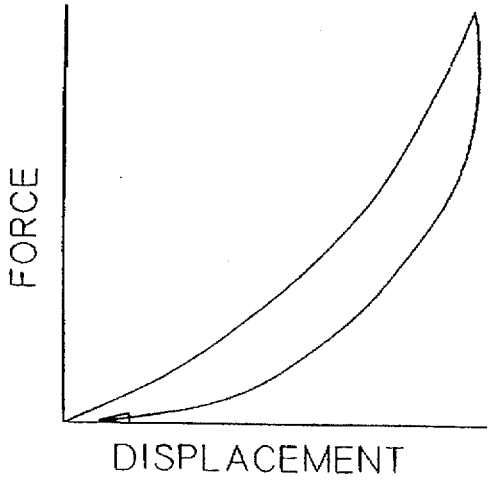
FIG. 15C illustrates a force versus travel curve for a purely elastomeric spring-driven end cushion device.
Figure 15D:
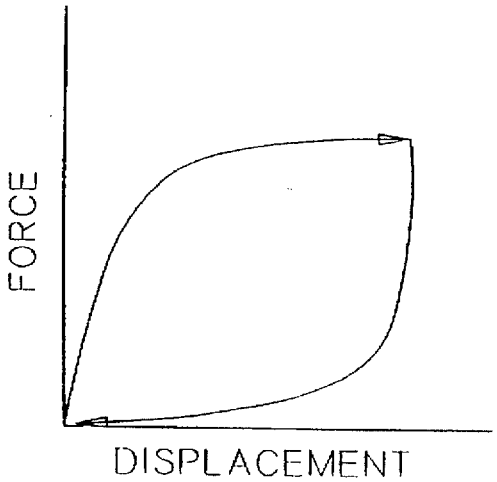
FIG. 15D illustrates a force versus travel curve for the present invention.
Figure 16:
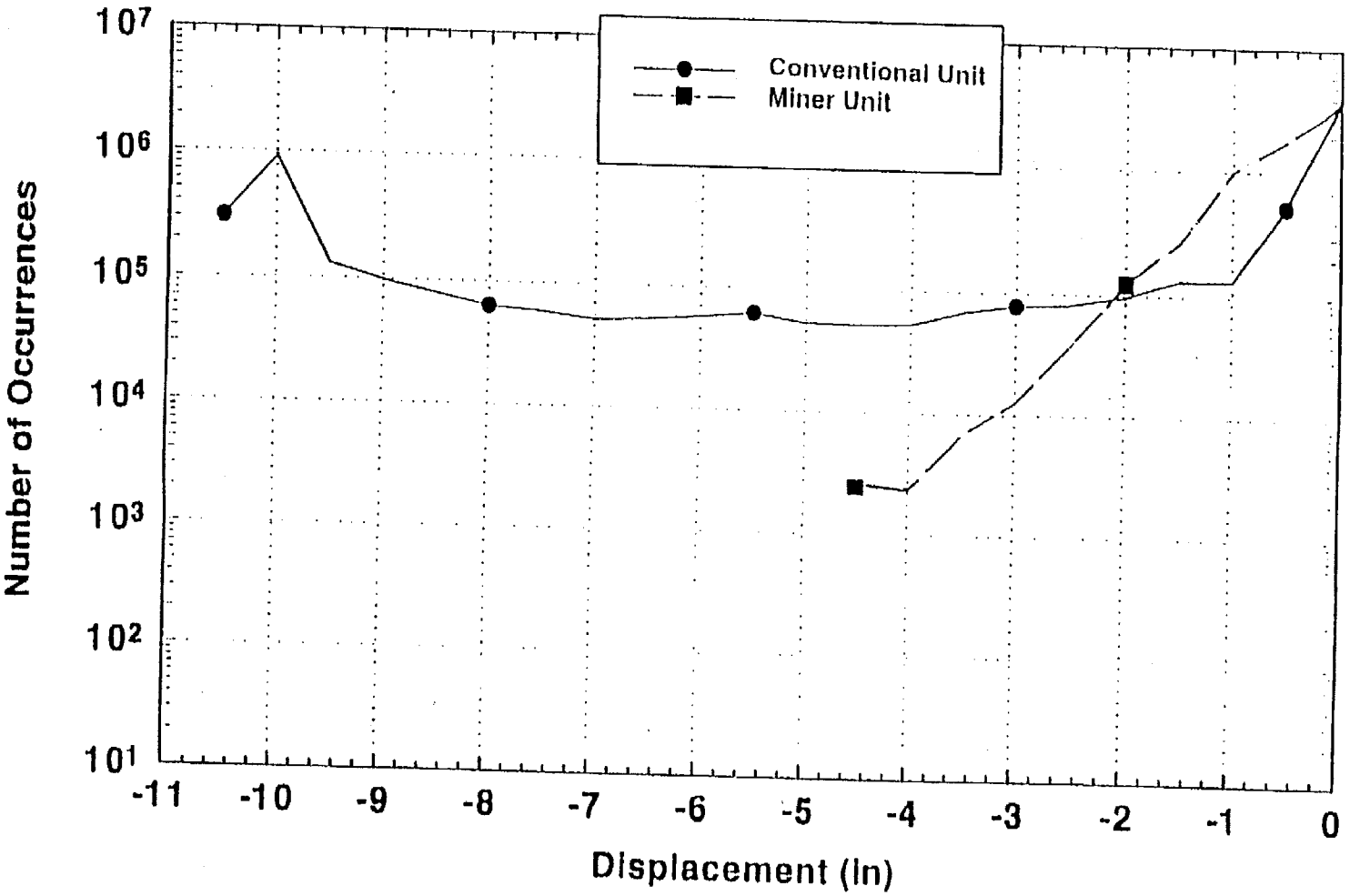
FIG. 16 is a graph comparing the buff displacement of the cushioning device of the present invention versus a conventional device (the buff direction is labeled negatively).

Turning attention now to FIGS. 4 and 5, the operation of the elastomeric spring assembly 190 will now be described. In either figure, it can be appreciated that whenever a buff load is transmitted through end sill casting member 400, the individual donuts or pads 192 will compress and absorb part of the inwardly directed compressive forces being experienced. The spacer plates 194 add rigidity to assembly 190 as it spreads during compression. The TECSPAK® material is designed to absorb forces much like a spring, and will absorb 150,000 ft.-lbs. per inch of compression. The object of the spring assembly is to minimize the peak import forces that are encountered on the device, over a given distance of retraction travel. As FIG. 15B shows, the perfect or ideal situation for end cushion device operation would exist when the device constantly absorbs forces over the entire distance the device is allowed to compress. FIG. 15B shows the force versus travel curve generated when only a hydraulic force absorbing system is used, while FIG. 15C shows the same curve when only an elastomeric cushioning system is used. As FIG. 15B shows, the problem of a purely hydraulic system is that they exhibit very high, peak forces very late in the force-absorption process. This is evidenced by the steep slope of curve occurring over a very short distance. The purely elastomeric system on the other hand, has the drawback of exhibiting a high peak force only after a greater or maximum amount of travel of the device. Literally, this means that the elastomeric system absorbs most of its forces upon initial compression and the more the elastomeric material is compressed, the less resistance to those forces is experienced. The present invention combines the most favorable features of each system so that the ideal force curve of FIG. 15A can be closely approximated. As FIG. 15D shows, the combined device of the present invention does exhibit the characteristics of the ideal force curve, because the elastomeric spring assembly absorbs the peak impact loads very early in the inward compression of device 25, while the hydraulic system tends to perform best just as the elastomeric system begins to fully compress. One advantage to the elastomeric spring assembly of the present device is that it is received about the outside surface of the operating cylinder 180. This equates to a stackable elastomeric spring system that does not necessitate a lengthwise extension to cushioning device 25, since this component is contained about the operating cylinder in physical parallelism with it, rather than in series with it. This arrangement also allows the present cushioning device to absorb the same amount of total energy as do prior art systems, but over a shorter distance of compression, and while minimizing the peak impact forces.

The above-mentioned elastomeric spring assembly also facilitates the re-location of the fluid accumulator outside of the operating cylinder. The import of locating an accumulator above and outside of the operating cylinders is twofold; first, it provides a location that is higher than the operating cylinder, thereby keeping it continuously gravity-fed with the heavy, air-displacing fluid; secondly, it allows for the formation of several, smaller-volumed fluid retention compartments which cooperate with each other to quickly transfer fluid throughout the cushioning device. The smaller reservoirs allow the cushioning device to have an almost-immediate response.

As FIG. 5 best illustrates, the fluid reservoir system has as its main components, an uppermost fluid accumulator 500, an internal reservoir 60, a fluid retention cavity 120 and the primary and second fluid chambers 135, 137. There are interconnecting fluid passageways and internal channels that support the reservoir system so that hydraulic fluid is readily communicated from either of the primary and secondary fluid chambers, up to the accumulator 500. These supporting components will become apparent once the system is functionally described in full detail. Interaction between all fluid communicating components is rather complex, with the intricacies being a function of the piston head position within operating cylinder 180 and the extent poppet valve gate 152 is positioned with respect to its seat 159.

The operation of the hydraulic fluid system of device 25 during buff loading will now be discussed in greater detail. The inward and longitudinal movement of end sill casting 400 causes fluid in primary chamber 135 to become compressed by piston head 110, which is held stationary since it is pinned at 325. As the primary chamber fluid become progressively compressed, the fluid will travel three fluid paths, each path being pressure dependent and not necessarily occurring simultaneously.

The first path is a direct routing of the fluid from the primary chamber into the secondary chamber. This path is best explained by viewing FIGS. 4 and 9–11. As was previously described, front end 114 of piston 110 is provided with a groove 113 cut longitudinally into each of the front piston ring lands 115A, 115B, 115C, and rear piston ring lands 119A, 119B, 119C, are provided with a similar longitudinal groove 117 that is in longitudinal alignment with front groove 113. However, it should be noted from viewing FIG. 11, that front groove 113 is deeper than rear groove 117, although the widths of each groove is the same extent. The front groove 113 is cut deeper so that more fluid will pass through this groove when compared to rear groove 117. The fluid that enters rear groove 117 passes therethrough and into secondary passageway 137. It should be obvious that any fluid passing between grooves 113 and 117 first occupies the internal cavity 120 and is held there until rear groove 117 passes the fluid held within cavity 120. This first fluid path is characteristically the fluid passageway that is operable during very minor compressive forces experienced on the cushioning device. These minor forces are typically caused during near standstill impact conditions (less than 4 mph) or when the unit train is moving and is experiencing progressively building fluid pressures such as when travelling downhill.

When the larger impact forces such as yard coupling forces are experienced at speeds over 4 mph, this first fluid path is still operably passing fluid between the primary and secondary chambers. However, since the railcar impact speed is increased, it necessarily follows that more extreme impact forces will be generated, and this is when the secondary groove 117 functionally begins to behave more like a flow-limiting orifice that causes the fluid in the primary chamber and internal cavity 120 to build pressure and seek alternate, less restrictive flow routes.

During the time period when the fluid pressure builds, the second fluid path becomes operable. This second path is dependent upon the fluid pressure in the primary chamber increasing to the point where the Belleville spring pressure against poppet valve gate 152 is exceeded, thereby causing gate 152 to unseat from seating surface 159. Depending upon the extent of deflection off the valve seating surface 159, the fluid that has entered funnel-like longitudinal opening 128, has two directions in which it can proceed. The first direction is for it to continue over and around surface 151 of valve gate 152, eventually entering piston head longitudinal passageways 140 at inlet end 143. FIG. 10 shows that four such passageways exist, and that each passageway is disposed at an angle so that each passageway exit end 141 does not interfere with the piston rod 102, which is screwed into the piston head. It can be appreciated that the four passageways 140 allow greater volumes of fluid to rapidly escape into secondary chamber 137.

The second flow path direction is best understood by viewing FIGS. 12–14, where the heavy arrows in FIG. 12, indicate that the fluid travels against valve seat surface 159 and surface 151 when poppet gate 152 depresses, allowing the fluid to enter the small rectangularly shaped annular groove 161. As FIG. 12 shows, valve body 154 is relieved first at 154A and then at 154B. These reliefs are intentionally provided so that when valve body 154 is secured within internal piston chamber 127 of piston head 110, an annular fluid communicating pocket 160 is created, and this pocket communicates fluid into the entrance 143 of each of the four longitudinal passageways 140. Thus, hydraulic fluid flowing centrally through piston head 110 eventually overcomes the spring tension against the poppet valve, thereby allowing fluid to flow into pocket 160 for displacement into passageways 140, where it is then transferred and received within secondary fluid chamber 137. As the pressure of the hydraulic fluid in the primary fluid chamber increases, the poppet valve assembly will further displace downwardly towards surface 129 and allow even more fluid into secondary fluid chamber 137 until the secondary chamber can no longer receive fluid at a fast enough rate when compared to the rate at which the primary chamber is emptying. At one point, the primary chamber capacity will eventually be decreasing at a faster rate than the filling rate of the secondary chamber, and this is when the third fluid path becomes operationally active.

Figure 8:
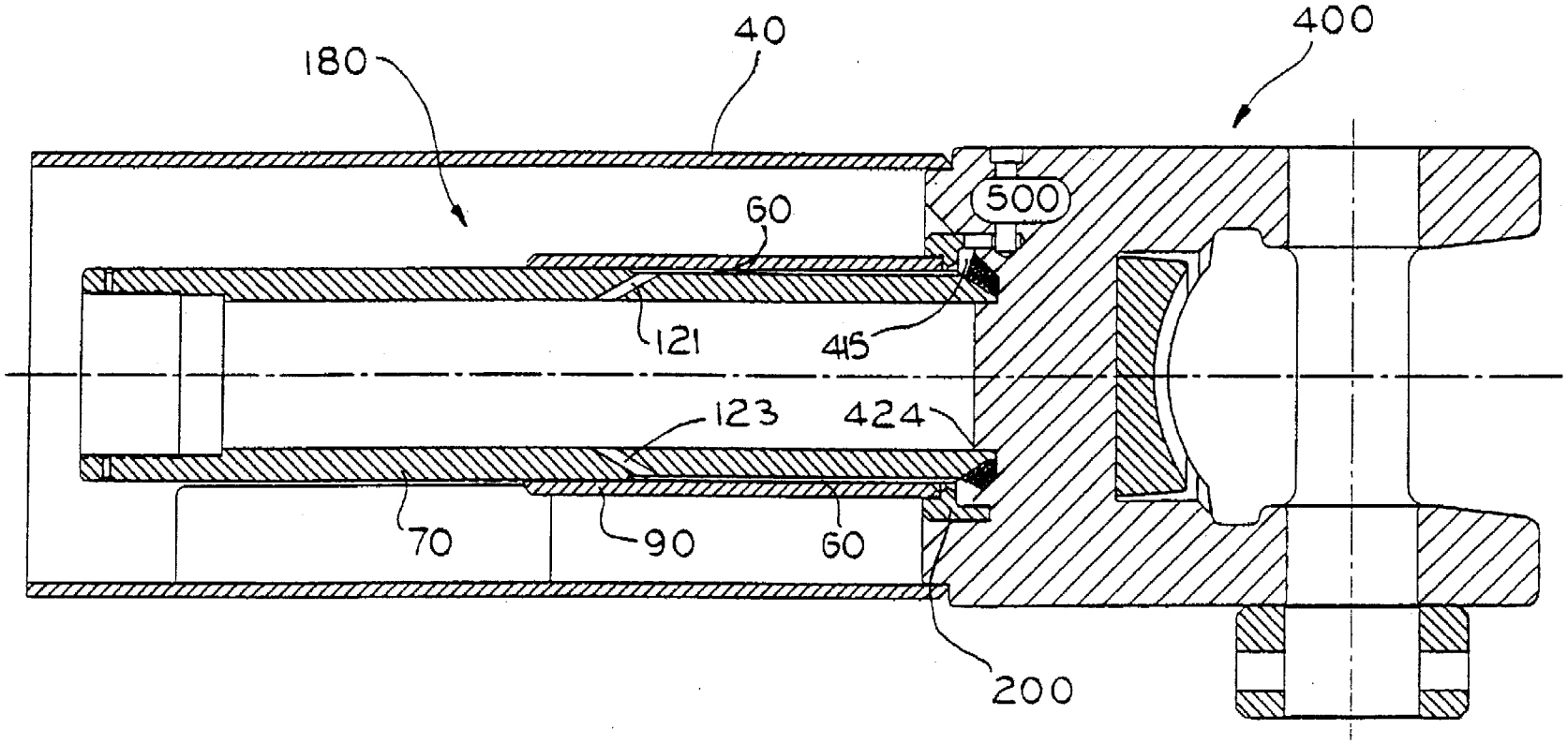
FIG. 8 is a fragmented side cross sectional view emphasizing the hydraulic fluid passages of the present invention.

This third path is best understood by viewing FIGS. 9, and 12–14 in conjunction with FIG. 8. FIG. 8 shows the operating cylinder and the fluid displacement means 100 removed from inner telescoping housing 30 in order to more easily explain the operation of the third fluid path. After the fluid pressure has greatly increased in direct proportion to the amount of inward displacement of outer telescoping housing 40, the fluid within primary chamber 135 can no longer empty into the secondary chamber at a fast enough rate, so the poppet valve assembly 150 effectively acts similar to a pressure relief system wherein the third fluid path allows flow to be directed to accumulator 500 located internally within the end sill casting member 400.

Fluid within fluid retention cavity 120 from the first flow path now becomes increasingly pressurized to the point where it too is limited in passing more fluid into secondary chamber 137, thus, the accumulation of fluid within cavity 120 actually reverses its flow direction away from secondary chamber 137. This reversal is facilitated by a very high pressure fluid entering the fluid retention cavity 120 through the four equidistantly spaced uptake ports 148, shown in FIG. 10. Since the opening 117 is effectively acting as a flow-limiting orifice at this point, the fluid is seeking the least restrictive path, which is now in the direction towards piston front end 114. Fluid will not re-enter the primary chamber because opening 113 is still allowing fluid to exit primary chamber 135; therefore, as FIG. 8 shows, the pressurized fluid within cavity 120 will flow upwardly into cavity vent holes 121,123. When the highly pressurized fluid is communicated into uptake ports 148 as a result of the poppet valve depressing to the point where the undercut portion 152C on the valve gate is in alignment with ports 148. As seen in FIG. 14, the poppet gate 152 has surface 152B normally blocking the uptake ports 148 when the valve gate is seated against seating surface 159, and this position is maintained even up to the moment where the third flow path finally becomes operative.

The vent holes 121,123 illustrated in FIG. 8 are located within the upper half of inner cylinder 70, in opposed relationship. The upward location of each vent hole is intentionally provided as such in order to facilitate air removal, as previously mentioned. From there, the hydraulic fluid enters internal reservoir 60, and travels towards end sill casting member 400. As mentioned earlier, cylinder adapter 200 and end 72 of inner cylinder 70 form the annular chamber 415, that is in fluid communication with reservoir 60, and the hydraulic fluid from the third flow path enters this annular chamber. FIG. 7 illustrates the relationship that chamber 415 has with respect to accumulator 500. The vertical passages 515, 516 are located within back wall 405 such that they intersect said annular chamber 415, as best seen from viewing FIG. 4. Thus, FIG. 4 clearly shows that fluid communication is now established with fluid accumulator 500. FIGS. 6 and 7 illustrate that accumulator 500 extends through back wall 405 so as to span the width of the back wall. FIG. 6 shows that end caps 525, 526 are required to seal each accumulator end, said caps being welded into place and necessary only because the casting process requires accumulator 500 to be initially formed as a continuous opening. Filler ports 504 (FIG. 7) are threaded to receive a threaded plug 505 after fluid has been added to cushioning device 25 and after all entrapped air has been displaced out of the device by the hydraulic fluid. In practice, it has been found that entrapped air can be displaced out of the device regardless of which vertical passageway is used for pouring the hydraulic fluid into.

Directing attention to FIGS. 12–14 again, one final operational aspect about poppet valve assembly 150 will be provided and it concerns the plurality of equally-spaced throughbores 157 that are drilled axially about the undercut portion 152C on valve gate 152. Each throughbore 157 is directed towards the center of gate 152 such that a centrally disposed blind bore 151 is in fluid communication with each one. The throughbores are provided so that when the poppet gate 154 begins to unseat from valve body seating surface 159, a small amount of fluid will enter the throughbore 151 so that fluid pressure builds against the bottom surface 153 of the valve gate. This is done in order to equalize the fluid pressure on both sides of the poppet valve gate, so that its motion is controlled solely by the forces exerted by the Belleville springs. It is important to understand that the tolerances between the surfaces of internal piston chamber 127, the poppet body 154, the poppet gate 152, and the lower portion 127B are extremely close, such that back pressures could otherwise build upon the poppet gate 152 and cause it to hydraulically lock in place. By providing the equalized pressure upon the gate, the potential for hydraulic lock is eliminated.

As mentioned earlier, the volumetric size of the accumulator is relatively small in comparison to prior art accumulators. The smaller size, as well as the series of internal fluid retention reservoirs and chambers, facilitates very rapid communication of fluid from the primary chamber into the accumulator. Likewise, any air entering the fluid system after it has been initially filled, is always displaced upwardly into accumulator 500, since the lower-most fluid retention compartments are always full with fluid. It should also be understood that after outer telescoping housing 40 contacts stops 33, cushioning device 25 is fully compressed, whereby the elastomeric pads 192 return the outer housing to its resting position, ready for a succeeding impact. The pressure differences between the fluid in the primary chamber and the secondary chamber allow the fluid to flow out of the accumulator and back into the primary chamber upon spring action of the elastomeric pads.

While the present invention has been described above in connection with a preferred embodiment, it will be understood that it is not intended to limit the invention to that embodiment. On the contrary, it is intended to cover all alternatives, modifications, and equivalents, as may be included within the spirit and scope of the invention as defined by the appended claims.

What is claimed is:

1. A cushioning device for operation within a railway center sill, said center sill having an open end and a longitudinal axis coextensive with a longitudinal axis of said device, a set of front stops disposed longitudinally inward of said center sill, and a set of back stops longitudinally inward of said front stops by a predetermined distance, said predetermined distance defining a center sill pocket for receiving said cushioning device, said cushioning device comprising:

an end sill member for receiving a butt end of a coupler, said end sill member having a back wall interconnecting a top, a bottom, a first and a second side walls, thereby defining an enclosure that faces and receives said butt end of said coupler, said back wall having a top and a bottom surface, a front surface, a back surface and a longitudinal extent between said front and back surfaces corresponding to a longitudinal thickness of said back wall, said back wall forming an opposed pair of lateral extensions in the form of upstanding tabs that abut said front stops, said back wall including a fluid accumulator near said top surface of said wall, said accumulator having an extent defined by said thickness of said back wall, said back wall further including an outer housing projecting from said back surface toward said back stops, said outer housing having an inside surface, an outside surface, a first and a second end and an open interior cavity;

a headstock member formed from a base plate having a front and a back surface, a rearward facing neck projecting off said back surface, an open, central throat extending through said neck and said front surface of said base plate, and an inner housing projecting from said front surface of said base plate, said base plate including an opposed pair of lateral extensions in the form of upstanding tabs, said inner housing having an inside surface, an outside surface, and a first and a second end, said first end connected to said base plate such that said housing interior communicates with said throat and is centered thereabout, said inner housing telescoping into said open interior cavity of said outer housing such that said outside surface of said inner housing is in close proximity to said inside surface of said outer housing, said inner and outer housings defining a body portion of said cushioning device;

an elastomeric spring assembly received within said body portion, said spring assembly comprised of a plurality of aligned energy-absorbing pads of a generally toroidal configuration, each of said pads separated from an adjoining pad by a spacer plate, said spacer plate having a central hole in alignment with a corresponding central hole in each of said pads;

an operating cylinder frictionally received Within said aligned holes of said elastomeric spring assembly, said operating cylinder comprised of an outer cylinder having an interior, an inner cylinder having an interior, and a means for displacing fluid, said means for displacing fluid comprised of a piston head connected to a piston rod, said inner cylinder concentrically arranged within said outer cylinder such that an internal annular fluid reservoir exists therebetween, said reservoir in communication with said interior of said inner cylinder through at least two vents, said fluid displacement means received within said interior of said inner cylinder and capable of displacing hydraulic fluid from said inner cylinder to said accumulator each of said inner and outer cylinders having a respective and corresponding first and second ends;

said operating cylinder having a first end and second end, said first end attached to said end sill member and said second end displaceable along said longitudinal axis such that said outer cylinder is slidably retractable within said open throat of said headstock, said second end of said inner cylinder closed by a sealing means which slidably receives said piston rod of said fluid displacement means, said fluid reservoir in fluid communication with said accumulator through an annular chamber;

said piston rod having a first end and a second end, and said piston head having a top end, a bottom end, and an outside surface, wherein said piston head bottom end is connected to said first piston rod end, said second piston rod end having an end cap attached thereon, said end cap generally conforming to said central throat and pinned to said headstock member such that said piston rod is in alignment with said longitudinal axis, said piston head arranged within said interior of said inner cylinder so as to define a primary fluid chamber and a secondary fluid chamber, said primary fluid chamber located between said top end of said piston head and said back of said end sill member, said secondary fluid chamber located between said piston head bottom end and said sealing means, each of said fluid chambers having a respective fluid volume when said fluid displacement means and said device is in a non-stroked and neutral position, said piston head including a relieved area in said piston outside surface, said relieved area creating a fluid retention cavity between said piston outside surface and said inner cylinder, each of said vents connecting said fluid retention cavity with said fluid reservoir and said accumulator when said operating cylinder is in a stroked position, said stroked position corresponding to a condition where a buff load operating on said cushioning device longitudinally displaces said outer housing such that said fluid displacement means causes fluid to flow from said primary chamber to said secondary chamber and into said accumulator after first flowing into said fluid retention cavity and then into said internal reservoir and annular chamber.

2. The cushioning device of claim 1, wherein said fluid accumulator is disposed vertically higher than said fluid reservoir and said primary and secondary fluid chambers.

3. The cushioning device of claim 2, wherein hydraulic fluid is initially supplied to said device via said accumulator, said hydraulic fluid gravity draining into said primary and secondary fluid chambers, thereby displacing any entrapped air in said device upwardly to said accumulator.

4. The cushioning device of claim 3, wherein said primary and secondary fluid chambers are free of entrapped air.

5. The cushioning device of claim 1, wherein said elastomeric spring assembly returns said piston head of said fluid displacement means to said non-stroked position at a higher rate of return relative to a gas-charged device.

6. The cushioning device of claim 1, wherein said elastomeric spring assembly prevents a complete close-out of said fluid displacement means, said close-out caused by a series of over-the-road impacts and corresponding slow-rate closures of said fluid displacement means, said spring assembly operable against said end sill member as a function of longitudinal, buff displacement of said end sill member, rather than as a function of an impact speed against said end sill member.

7. In a railway car center sill operable to receive a standard AAR coupler, and end-of-sill cushioning arrangement for operation within said center sill which absorbs and dissipates buff and draft loading forces transferred into said device from a said coupler connected thereto, said center sill having an open end and a longitudinal axis coextensive with a longitudinal axis of said device, a set of front stops disposed longitudinally inward of said center sill, and a set of back stops longitudinally inward of said front stops by a predetermined distance, said predetermined distance defining a center sill pocket for receiving said cushioning device, comprising:

an end sill member coupled to a butt end of said coupler, said end sill member having a back wall interconnecting a top, a bottom, a first and a second side walls, thereby defining an enclosure that faces and receives said butt end of said coupler, said back wall having a top and a bottom, a front surface, a back surface and a longitudinal extent between said front and back surfaces corresponding to a longitudinal thickness of said back wall, said back wall including a top fluid accumulator at said top of said wall said accumulator formed within said thickness of said back wall and in vertical alignment to each other, said back wall including an opposed pair of lateral extensions in the form of upstanding tabs, each of said tabs having a front face in abutting contact with one of said front stops of said center sill, said back wall further including an outer housing projecting from said back surface toward said back stops, said outer housing defined by an inside surface, an outside surface, a first and a second end surface, and an open interior cavity;

a headstock member having a base plate with a front and a back surface, a rearward facing neck projecting off said back surface, an open, central throat extending through said neck and said front surface of said base plate, and an inner housing projecting off said front surface of said base plate, said base plate including an opposed pair of extensions in the form of upstanding lugs, each of said lugs having a front surface in abutting contact with one of said back stops of said center sill, said inner housing having an interior defined by an inside surface, an outside surface, and a first and a second end surface, said inner housing telescoping into said interior cavity of said outer housing such that said outside surface of said inner housing is in close proximity to said inside surface of said outer housing, said inner and outer housings defining a body portion of said cushioning device;

an elastomeric spring assembly received within said body portion, said spring assembly comprised of a plurality of aligned energy-absorbing pads of a generally toroidal configuration separated from an adjoining pad by a spacer plate, each of said spacer plates having a centered hole in alignment with a centered hole in each of said pads;

an operating cylinder frictionally received within said aligned holes of said elastomeric spring assembly, said operating cylinder comprised of an outer cylinder having an interior, an inner cylinder having an interior, and a means for displacing fluid, said inner cylinder concentrically arranged within said outer cylinder such that a fluid reservoir exists therebetween, said reservoir in communication with said interior of said inner cylinder through at least two vents, said fluid displacement means received within said interior of said inner cylinder and capable of displacing hydraulic fluid from said inner cylinder to said accumulator, said operating cylinder having a fixed end and restricted end, said fixed end attached to said end sill member, and said restricted end displaceable along said longitudinal axis such that said outer cylinder is slidably retractable into and out of said headstock open throat, said inner cylinder having a second end that is sealed by a sealing means which slidably receives a piston rod of said fluid displacement means, said fluid reservoir in communication with said accumulator through a top passageway, said means for displacing fluid comprised of a piston rod having a first end and a second end, a piston head having a top end, a bottom end, and an outside surface, wherein said bottom end is connected to said first piston rod end, and an end cap is attached to said second piston rod end, said end cap generally conforming to said central throat and pinned to said headstock member, thereby supporting and maintaining said second piston rod end in alignment with said longitudinal axis, said piston head arranged within said interior of said inner cylinder so as to define a primary chamber and a secondary chamber, said primary chamber located between said top end of said piston head and said back of said end sill member, said secondary chamber located between said piston head bottom end and said sealing means, said primary chamber in communication with each of said vents when said operating cylinder is in a non-stroked position, said non-stroked position corresponding to a condition where no buff/draft loads are operating on said cushioning device and wherein entrapped air is expelled from said primary and secondary chambers by hydraulic fluid upwardly displacing said air from said chambers into said top accumulator, said piston head including a stepped, relieved area in said piston outside surface, said relieved area creating a fluid retention cavity between said outer and inner cylinders, each of said vents connecting said fluid retention cavity with said fluid reservoir when said operating cylinder is in a stroked position, said stroked position corresponding to a condition where buff/draft loads are operating on said cushioning device and wherein said operating cylinder immediately absorbs and dissipates energy from said buff/draft loads due to the primary and secondary chambers being free from entrapped air.

8. The cushioning arrangement of claim 7, wherein said fluid accumulator is disposed vertically higher than said fluid reservoir and said primary and secondary fluid chambers.

9. The cushioning arrangement of claim 8, wherein hydraulic fluid is supplied to said device via said accumulator, said hydraulic fluid gravity draining into said primary and secondary fluid chambers, thereby displacing any entrapped air in said device upwardly to said accumulator.

10. The cushioning arrangement of claim 9, wherein said primary and secondary fluid chambers are always free of entrapped air.

11. The cushioning arrangement of claim 10, wherein said operating cylinder is ready to immediately absorb and dissipate energy from impact loads due to said primary and secondary chambers being free from entrapped air.

12. The cushioning arrangement of claim 11, wherein said elastomeric assembly and said operating cylinder simultaneously absorb impact forces, thereby reducing a longitudinal travel distance of said outer telescoping housing.

13. A cushioning device for operation within a railway center sill, said center sill having an open end and a longitudinal axis coextensive with a longitudinal axis of said device, a set of front stops disposed longitudinally inward of said center sill, and a set of back stops longitudinally inward of said front stops by a predetermined distance, said predetermined distance defining a center sill pocket for receiving said cushioning device, said cushioning device comprising:

an end sill member for receiving a butt end of a coupler and which abuts said center sill front stops, said end sill member including at least one hydraulic fluid accumulator formed therein and having an outer telescoping housing member attached thereto, said outer housing projecting towards said back stops and having an interior;

a headstock member having a base plate in abutting contact with said back stops, said headstock member including an inner housing projecting from said base plate towards said front stops, said inner housing received within an interior of said outer housing, said base plate including a centered throat in communication with said interior of said inner housing and said inner and outer housings defining a body portion;

an elastomeric spring assembly received within said body portion and extending between said end sill and headstock members, said assembly having a central throat therein;

an operating cylinder attached at one end to said end sill member, said operating cylinder comprised of an outer cylinder, an inner cylinder, and a fluid displacement means, said inner cylinder concentrically arranged within said outer cylinder and said fluid displacement means frictionally inserted within an interior of said inner cylinder and longitudinally operable therein, said inner and outer cylinders forming a fluid reservoir therebetween and wherein said interior of said inner cylinder is in communication with said fluid reservoir through at least one vent, said outer cylinder including an end cap at its other end said inner cylinder sealed at its other end by a sealing means;

said fluid displacement means comprised of a piston head attached to one end of a piston rod, another end of said piston rod extending through said sealing means and into said throat of said headstock member and being anchored thereto, said piston head having an outer surface, a top end, and a bottom end, said outer surface having a relieved portion which forms a fluid cavity between said piston head and said interior of said inner cylinder, said piston head defining a primary fluid chamber and a secondary fluid chamber within said inner cylinder, said piston head including an internally housed poppet valve, said valve communicating fluid between said primary and secondary chambers;

wherein in a non-stroked position, said piston is arranged within said operating cylinder such that said fluid accumulator is indirectly in communication with said primary and secondary fluid chambers, thereby allowing any entrapped air within said chambers to upwardly rise into said fluid accumulator, thereby maintaining said primary and secondary chambers in an air-free condition, said air-free condition allowing said impact loads experienced by said device to be immediately absorbed by said hydraulic component when said piston rod is later displaced to a stroked position.

14. The end cushioning device of claim 13, wherein hydraulic fluid, displaces entrapped air from said primary and secondary fluid chambers upwardly into said fluid cavity, then into said vents, then into said fluid reservoir, before entering said fluid accumulator.

15. The end cushioning device of claim 14, wherein said hydraulic fluid follows a fluid path when said displacement means is in a stroked position, said fluid path facilitating a rapid movement and expansion of said fluid, thereby causing a reduction in a fluid pressure within said primary fluid chambers when said device is impacted.

16. A cushioning device for operation within a railway center sill, said center sill having an open end and a longitudinal axis coextensive with a longitudinal axis of said device, a set of front stops disposed longitudinally inward of said center sill, and a set of back stops longitudinally inward of said front stops by a predetermined distance, said predetermined distance defining a center sill pocket for receiving said cushioning device, said cushioning device comprising:

an end sill member having an enclosure for receiving a butt end of a coupler member, said end sill member in abutting contact with said front stops and including an attached housing member projecting towards said rear stops and an internal fluid accumulator, said housing member having an internal cavity therein;

a headstock member having a central throat extending therethrough and an attached housing member surrounding said throat and projecting towards said front stops, said housing member having an internal cavity and projecting into said cavity of said end sill housing member, said housing members defining a central body portion of said device, which said body portion defines a continuous, open cavity extending between said end sill and headstock members;

an elastomeric spring assembly extending throughout said central body portion and having a longitudinally disposed central bore therein;

an operating cylinder received within said central bore of said spring assembly, comprised of an inner and an outer cylinder concentrically arranged in frictional contact, each of said cylinders having a respective and corresponding first and second end, said first ends of said cylinders mounted to said end sill member, said second end of said inner cylinder including a sealing means for enclosing said end, said second end of said outer cylinder enclosed by an end cap which said end cap is connectively pinned to said headstock member, said end cap and said second end of said outer cylinder located within said central throat, said inner cylinder having recessed outer surface at said first end thereof that forms an internal annular reservoir between said cylinders, said reservoir in communication with said accumulator;

a fluid displacement means comprised of a cylindrical piston head attached to a piston rod, said piston rod attached to said end cap and extending through said sealing means, said piston head disposed within said inner cylinder, thereby forming a primary fluid chamber and a secondary fluid chamber, each of said fluid chambers being full of hydraulic fluid, said primary chamber located between said piston head and said end sill member, said secondary chamber located between said piston head and said sealing means, said piston head having a relieved area on an outside surface thereof that forms a fluid retention cavity between said piston head and said inner cylinder, said fluid retention cavity in communication with said internal reservoir through a set of vents located through said inner cylinder;

a poppet valve assembly internally disposed within said piston head for directing hydraulic fluid from said primary chamber into said secondary chamber and into said accumulator when said device is impacted by a longitudinally directed buff force.

* * * * *